United States Patent [19]

Jordan et al.

[11] 3,981,648

[45] Sept. 21, 1976

[54] POWER TRANSMISSION

[75] Inventors: Kenneth T. Jordan, Madison Heights; Norman A. Sowers, Lincoln Park, both of Mich.

[73] Assignee: Sperry Rand Corporation, Troy, Mich.

[22] Filed: Oct. 23, 1974

[21] Appl. No.: 517,333

[52] U.S. Cl. ..... 418/267

[51] Int. Cl.[2] ..... F01C 19/02

[58] Field of Search ..... 418/267, 268

[56] References Cited

UNITED STATES PATENTS

| | | | |
|---|---|---|---|
| 2,861,517 | 11/1958 | Neff | 418/267 X |
| 3,120,154 | 2/1964 | Gilreath | 418/267 X |
| 3,329,067 | 7/1967 | Rosaen | 418/268 X |
| 3,869,231 | 3/1975 | Adams | 418/268 X |

FOREIGN PATENTS OR APPLICATIONS

| | | | |
|---|---|---|---|
| 1,250,968 | 12/1960 | France | 418/267 |
| 1,146,111 | 11/1957 | France | 418/267 |

*Primary Examiner*—C. J. Husar
*Assistant Examiner*—Leonard Smith
*Attorney, Agent, or Firm*—Theodore Van Meter

[57] ABSTRACT

A rotary sliding vane type of fluid pump or motor has a rotor with loosely fitted vanes radially slidable in the rotor slots to follow the varying contour of the cam ring. Hydraulic pressure to project the vanes outwardly is fed to their inner ends along three paths comprising the side clearance between the slot and the vane which is open directly to one of the working chambers, a first set of pressure feed holes communicating with the bottom of each slot in turn, and a second set of pressure feed holes communicating with a widened portion of each slot in turn intermediate its ends.

1 Claim, 3 Drawing Figures

POWER TRANSMISSION

In rotary hydraulic power units of the sliding vane type and particularly those used as motors operatable at very slow as well as moderate speeds, the range of speeds over which smooth, steady and quiet operation can be assured has been quite limited. Also, it has been difficult to assure smooth operation when run with highly viscous fluids. One method of extending the range of speeds or viscosities has been to utilize loosely fitting vanes in the slots so that the vanes will cock to one side or the other of the slot depending on which side is exposed to high pressure at the tip of the vane. However, if too much looseness is introduced to secure satisfactory operation at higher speeds or viscosities, then difficulties occur such as excessive noise and erratic motion at very low speeds.

The present invention aims to extend the range of speeds and viscosities over which satisfactory operation of the unit can be reliably assured.

This result is accomplished by the provision of a hydraulic pump or motor unit of the rotary sliding vane type comprising a body formed by a non-circular cam ring and opposed end members having flat interior faces, inlet and outlet ports in the body, and further comprising a rotor having sliding engagement with the faces of the end members and being provided with generally radial slots and with vanes radially reciprocable in the slots, to contact the cam ring along its interior circumference, the unit having the improvement which comprises a hydraulic vane projection system utilizing in addition to the known loose fit between the vanes and their slots and the known pressure feed holes in the end member faces communicating with the bottom of the slots, a widened portion in each slot intermediate its ends and a second set of pressure feed holes communicating with the widened portions of the slots.

Figure 1:
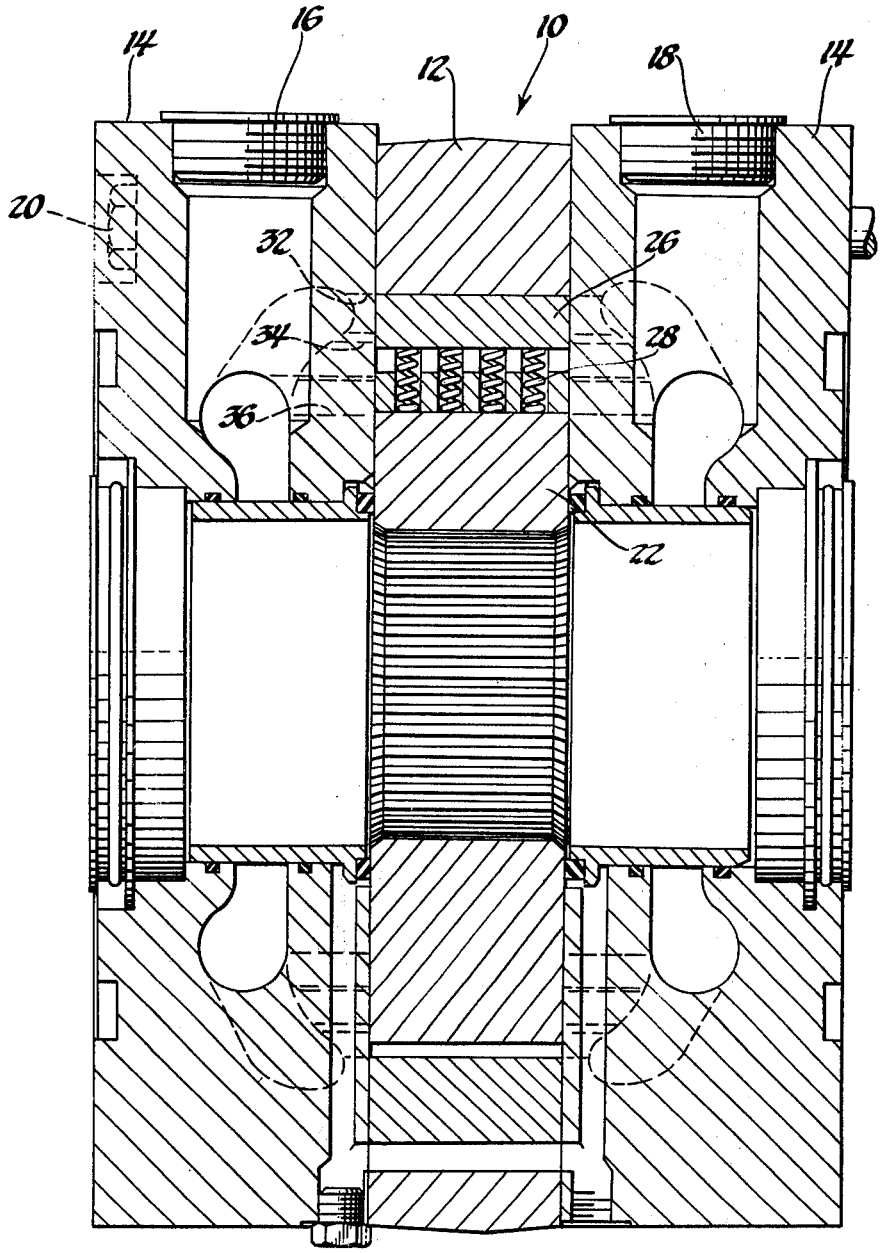
FIG. 1 is a cross sectional view of a hydraulic vane motor embodying a preferred form of the present invention.

In the embodiment illustrated in the drawings, a body 10 is formed by a cam ring 12 and a pair of oppositely facing end plates 14 provided with inlet and outlet porting 16 and 18. These three parts may be clamped together by a plurality of bolts such as 20. Positioned for rotation within the cavity formed by the three body members is a rotor 22 having a plurality of radial slots 24, within which vanes 26 are radially slidable. A plurality of springs 28 are mounted in slots in the vanes to urge them outwardly. The rotor has a central splined bore for engagement with a drive shaft, not shown.

Figure 3:
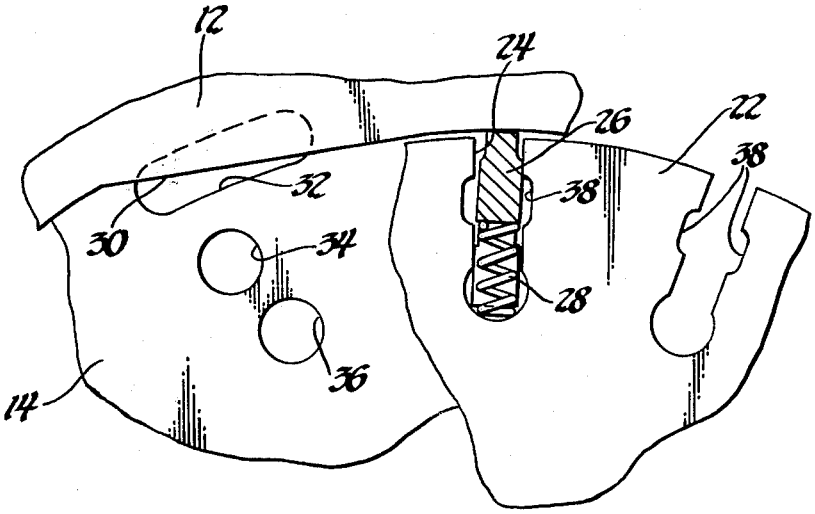
FIG. 3 is an enlarged fragmentary view of a portion of the ring, rotor and vanes of FIG. 2.

Referring to FIG. 3, a portion of the cam ring 12 containing a ramp 30 lies opposite a main port 32 in one of the end members 14 which is in communication with the port 16 as illustrated in FIG. 1. Similarly, auxiliary pressure feed ports 34 and 36 are also in communication with the port 16. Port 36 supplies fluid to the bottom of the vane slots 24 in turn as they pass in the well known manner, to assist in projecting each vane outwardly as it passes along the ramp 30. Port 34 communicates in turn with each of the vane slots as they pass. For the purpose of providing adequate flow from the port 34, each vane slot is provided with an enlarged portion 38. Ports in the end faces of the members 14 similar to the ports 32, 34 and 36 are provided at each of the ramp portions of the cam ring, as illustrated in dotted lines in FIG. 1.

Figure 2:
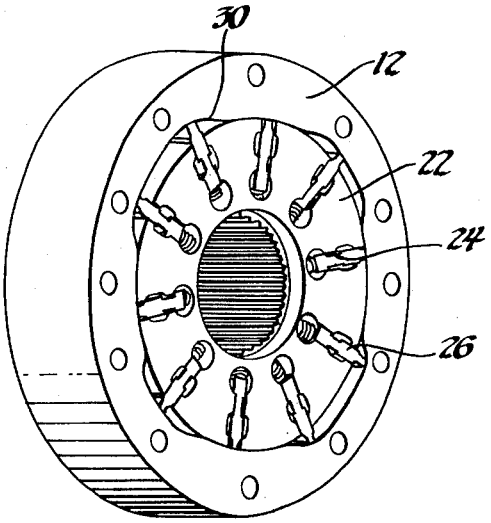
FIG. 2 is a perspective view of the cam ring, rotor and vanes of the unit in FIG. 1.

In operation, for motor operation counter-clockwise in FIGS. 2 and 3, pressure fluid will be admitted to the port 16 and 18 will be connected to an outlet conduit. Thus, vane 6 in FIG. 3 will have high pressure on its left hand face and low pressure on its right hand face and will cock in the slot so as to open a small passage down the slot along its left hand side. As the rotor 22 turns (due to pressure acting on other vanes, not shown in FIG. 3, to the left of the one illustrated) pressure feed port 36 will be opened to the bottom of the vane slot, and in the known manner pressure fluid from these two sources will assist the springs 28 in projecting the vane 26 outwardly. As soon as the auxiliary feed port 4 opens to the enlargement 38, a third path will be opened for flow to the lower end of the vane slot, thus augmenting the pressure feed and increasing the permissible speeds and viscosities at which reliable operation of the motor is assured.

We claim:

1. A hydraulic pump or motor unit of the rotary sliding vane type comprising a body formed by a non-circular cam ring and opposed end members having flat interior faces, inlet and outlet ports in the body, and further comprising a rotor having sliding engagement with the faces of the end members and being provided with generally radial slots and with vanes significantly narrower than the slots and radially reciprocable in the slots to contact the cam ring along its interior circumference, the unit having the improvement which comprises a hydraulic vane projection system utilizing in addition to the known fluid flow path between the sides of the slots and the sides of the significantly narrower vane and the known pressure feed holes in the end member faces communicating with the bottom of the slots, a widened portion in each slot intermediate its ends and a second set of pressure feed holes communicating with the widened portions of the slots.

* * * * *